US006426684B1

(12) United States Patent
Watkins

(10) Patent No.: US 6,426,684 B1
(45) Date of Patent: Jul. 30, 2002

(54) POINT DETECT FILTER

(75) Inventor: Robert A. Watkins, Goleta, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 07/701,395

(22) Filed: May 16, 1991

(51) Int. Cl.[7] ..... H04B 7/10; H01Q 21/06
(52) U.S. Cl. ..... 333/202; 333/138; 342/362
(58) Field of Search ..... 333/138, 202; 382/23; 342/53, 362; 250/342, 338

(56) References Cited

U.S. PATENT DOCUMENTS 4,992,798 A * 2/1991 Nozue et al. ..... 342/362
5,023,620 A * 6/1991 Matsuura ..... 342/362

FOREIGN PATENT DOCUMENTS

| | | | |
|---|---|---|---|
| GB | 2122547 | 1/1984 | ..... B41F/33/00 |
| NL | 0860004 | 2/1961 | |

* cited by examiner

*Primary Examiner*—Nelson Moskowitz
(74) *Attorney, Agent, or Firm*—William C. Schubert; Glenn H. Lenzen, Jr.

(57) ABSTRACT

An electronic warfare system for detecting missiles which appear as points in an IR image. The system includes a point detect filter with two stages. The first stage produces a characteristic rabbit ear pattern in response to a pulse. The second stage produces a pulse in response to the rabbit ear pattern.

10 Claims, 3 Drawing Sheets

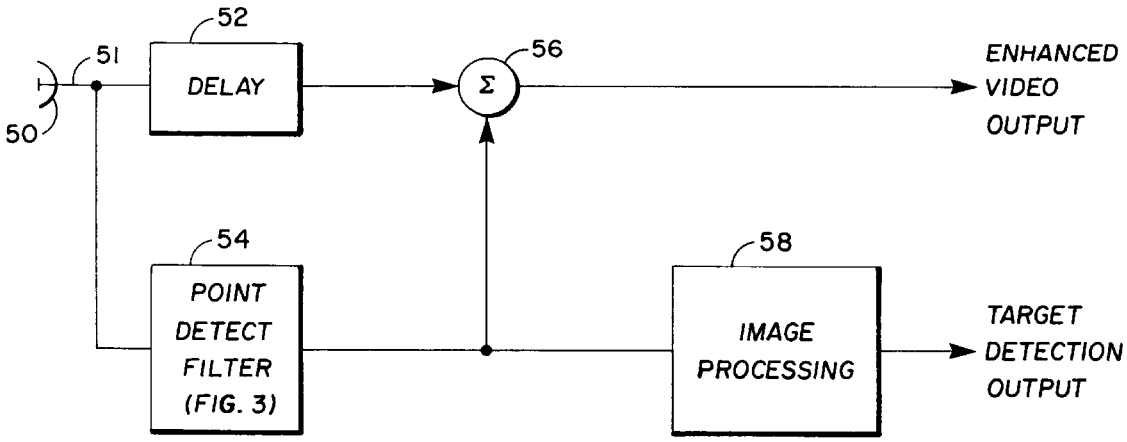
Fig. 2
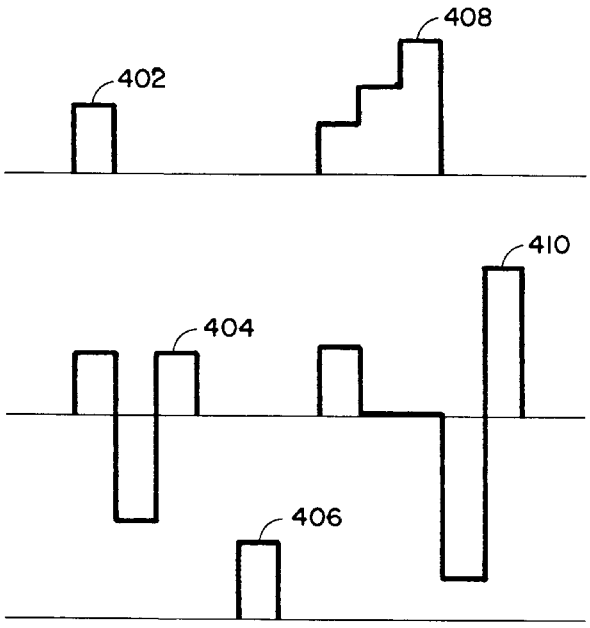
Fig. 4A
Fig. 4B
Fig. 4C

POINT DETECT FILTER

BACKGROUND OF THE INVENTION

This application relates generally to processing of images and more particularly to processing images to identify points.

In various types of systems, images are formed and then processed. As a result of the processing, features of the image are detected.

For example, in electronic warfare (EW) systems infrared (IR) detectors are used to form images of objects. These systems are mounted on vehicles, such as aircraft. Processing of the IR image results in the detection of missiles heading towards the vehicle. The EW system can then take measures to jam the missiles so they do not strike the aircraft.

For the EW system to be effective, it must detect the missile while it is still relatively far from the aircraft. At this distance, the missile appears as a small point in the IR image. Thus, the EW system must be able to detect points in the image.

The problem of detecting points is made more difficult by large background variations in the image. Some methods of detecting points include first high pass filtering the image to remove background noise. However, conventional filters have a step response which may add spurious pulses to the residual image when certain image features are filtered.

According to another approach, the entire image is digitized without filtering. The pulses can then be detected using conventional correlation processing techniques. However, this approach requires an analog to digital converter with a very large dynamic range to resolve the small amplitude pulses from the very large amplitude background variations.

SUMMARY OF THE INVENTION

With the foregoing background in mind, it is an object of this invention to provide a filter which can detect pulses in an image.

It is further an object to provide a filter which does not introduce spurious signals into the filtered image.

It is yet another object to provide a filter useful in an EW system.

It is still further an object to provide a filter useful in any detecting system.

The foregoing and other objects are achieved by a multistage filter. The first stage produces a predefined output in response to an input pulse. The second stage produces a pulse output when the first stage produces the predefined output. The output of the second stage gates the portion of the input image containing the pulse to conventional circuitry for further processing.

BRIEF DESCRIPTION OF THE DRAWINGS

The invention will be better understood by reference to the following more detailed description and accompanying drawings in which

FIG. 2 is a block diagram of a system in which the invention might be employed;

FIGS. 4A–4C are timing diagrams showing the relationship of signals at various nodes in the circuit of FIG. 3.

DESCRIPTION OF THE PREFERRED EMBODIMENT

Figure 1:
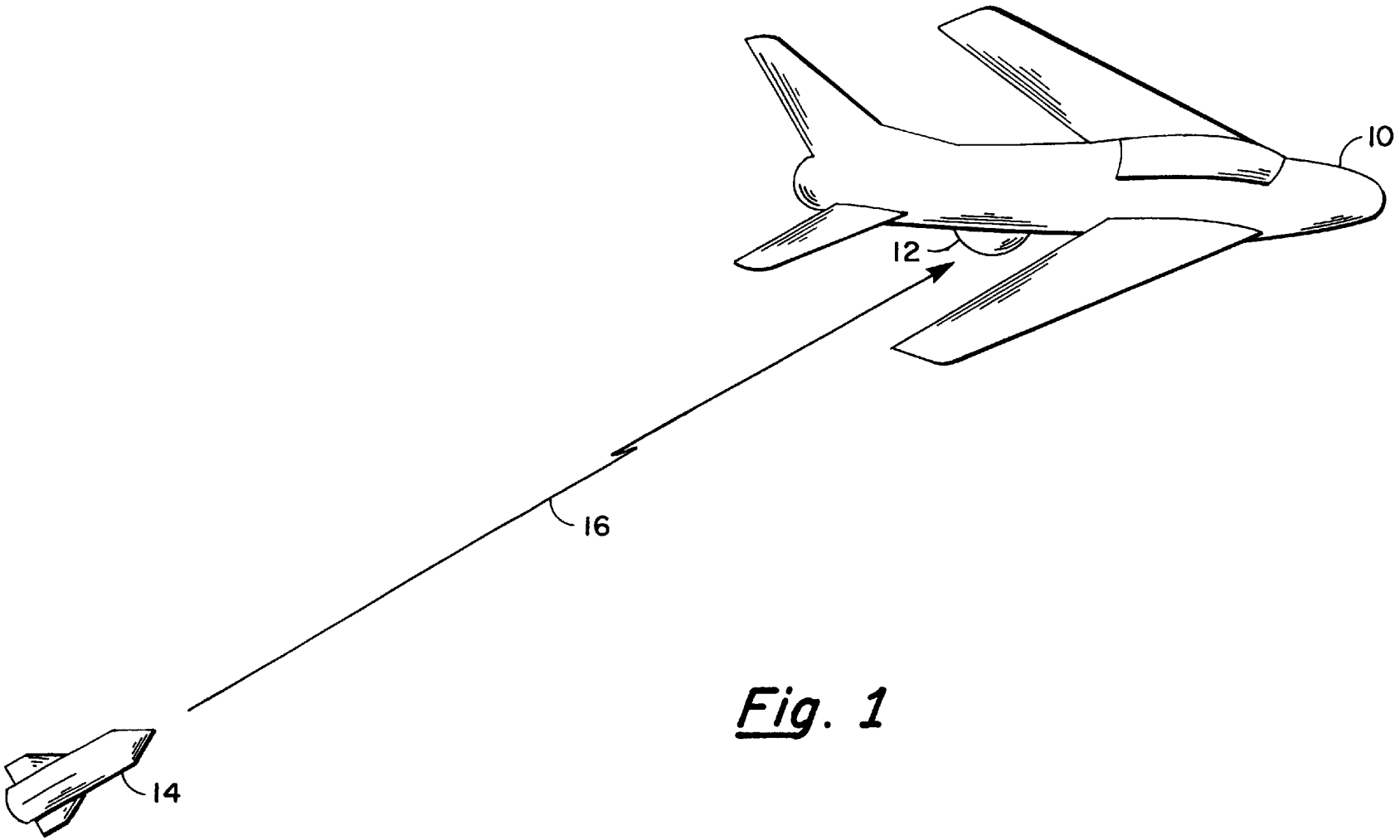
FIG. 1 is a simplified sketch of a scenario in which the invention might be employed.

FIG. 1 shows an aircraft 10 equipped with an electronic warfare (EW) pod 12. EW pod 12 contains systems to detect and jam missiles which might destroy aircraft 10. One such system, described in greater detail in conjunction with FIG. 2, detects missile 14 from infrared (IR) radiation 16 generated by missile 14.

FIG. 2 shows a system in EW pod 12 (FIG. 1) for identifying the presence of missile 14 (FIG. 1). Detector 50 forms an IR image of the region around missile 14 (FIG. 1). The IR image is represented as an analog signal on line 51. As in a conventional IR system, the signal on line 51 has an amplitude which varies in accordance with the intensity seen as the image is scanned. Scanning is conventionally performed on images and may be accomplished with mechanical means or done electronically. The scanning proceeds over the image in some predetermined fashion. For example, in a conventional raster scan, scanning proceeds across the image and then down to the next row in the image. When all rows of the image are scanned, another frame of the image is formed.

The image is provided to delay element 52 and to point detect filter 54. Point detect filter 54 is described in greater detail below. Suffice it to say, the output of point detect filter 54 is a mostly featureless image scanned in the same fashion as that on line 51 with bright spots in locations corresponding to points in the image on line 51.

The output of point detect filter 54 is provided to summer 56. The other input of summer 56 is the signal on line 51 after it has been delayed by delay element 52. Delay element 52 is an analog delay element of known construction. The delay introduced by delay element 52 is selected to match the delay introduced by point detect filter 54. Thus, the output of summer 56 is an image which resembles the input image with the intensity of any points in the image increased. The output of summer 56 can be displayed on a monitor (not shown) for a human to view or can be processed in other known ways.

The output of point detect filter 54 is also provided to image processing circuitry 58, which is of conventional design. Image processing circuitry 58 might, for example, contain a microprocessor programmed to select points from the image produced by point detect filter 54 which represent a missile approaching aircraft 10 (FIG. 1). In a conventional system, this determination is made by observing the "track" made by a point in successive frames of an image. In this way, noise sources which do not persist from frame to frame are ignored.

It will be noted by one of skill in the art that point detect filter 54 detects a point in an image as one row of the image is being scanned. However, in the case of a conventional raster scan, a thin vertical line will appear as a point in each row. Thus, the output of point detect filter contains points which are not true points. Image processing circuit 58 compares the points in any row of the image with points in adjacent rows. Image processing circuit 58 ignores any point adjacent to a point in another row.

The output of image processing circuit 58 indicates the presence of missile 14 (FIG. 1) approaching aircraft 10 (FIG. 1). This indication is provided to conventional circuitry (not shown) in EW pod 12 (FIG. 1) to jam missile 14 or take other appropriate action.

Figure 3:
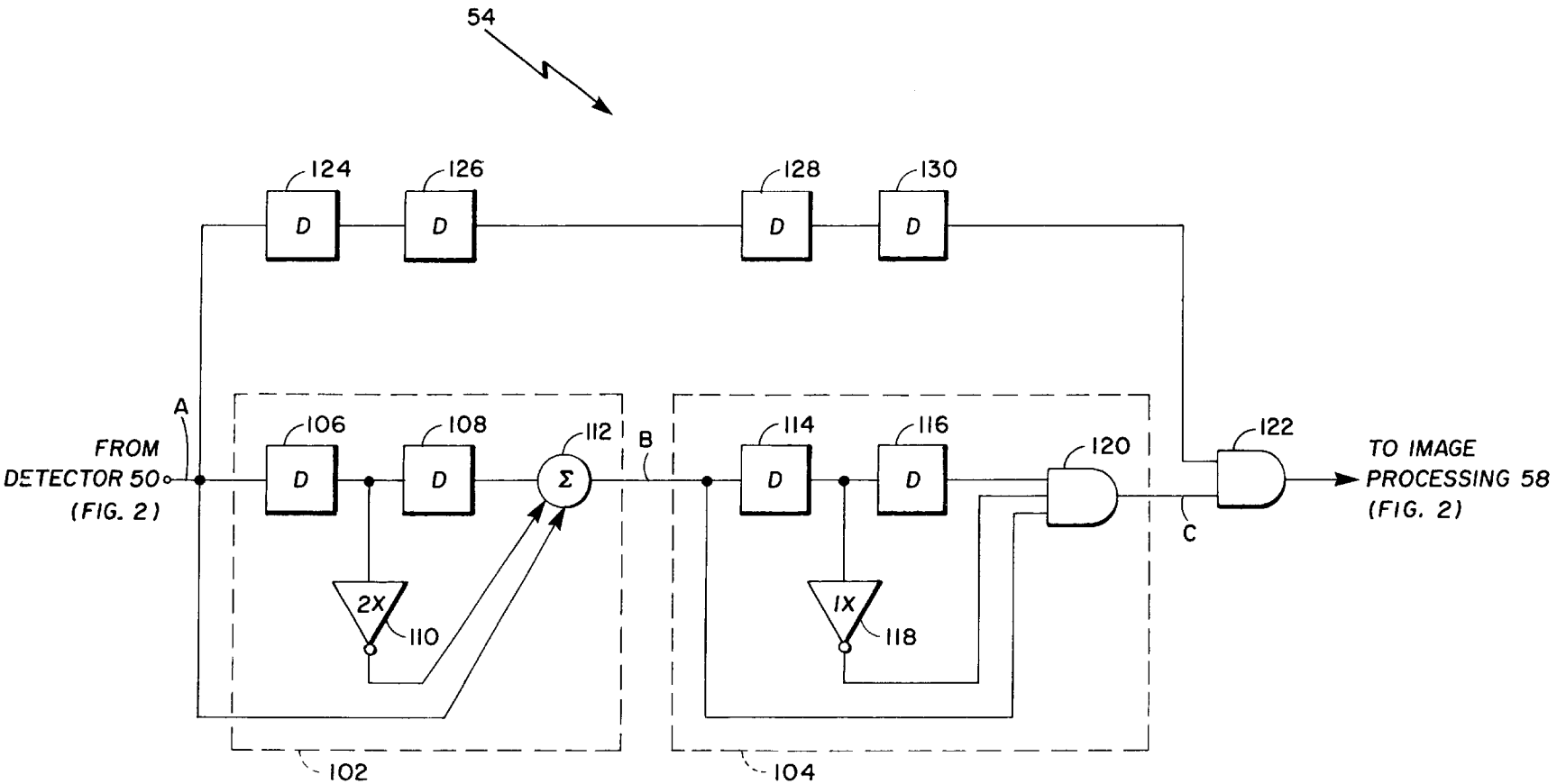
FIG. 3 is a block diagram of a point detect filter according to the invention.

Turning now to FIG. 3, further details of point detect filter 54 are shown. Point detect filter 54 has two stages shown as first stage 102 and second stage 104. First stage 102 produces an output of a predetermined shape when a pulse is applied at node A. Second stage 104 detects this predetermined output and produces a pulse at node C in response. A pulse output at node C enables the portion of the input image signal to be passed through gate 122 to the output of point detect filter 54.

First stage 102 contains two delay elements 106 and 108 in series. Delay elements 106 and 108 are conventional analog delay elements—such as delay lines. Each delay line has one unit of delay. A unit of delay equals the width of the narrowest pulse that could be produced by detector 50. As a rule of thumb, this delay roughly equals the angular width of detector 50 divided by the rate at which detector 50 is scanned.

Inverting amplifier 110 is connected to the point between delay elements 106 and 108. Inverting amplifier 110 has a gain of two, but its output has the opposite polarity of its input.

The input at node A, the output of inverting amplifier 110, and the output of delay element 108 are summed at summer 112. Summer 112 is of known construction, such as a conventional summing amplifier. The output of summer 112 is the output of first stage 102.

When pulse 402 (FIG. 4A) is applied at node A, the signal at node B will be the "rabbit ear" pattern 404 (FIG. 4B). Other types of inputs such as ramp 408 (FIG. 4A) will produce different signals at node B, such as pattern 410.

Second stage 104 recognizes rabbit ear pattern 404 (FIG. 4B) and produces an output pulse at node C only when that is present. Second stage 104 contains two delay elements 114 and 116, which are similar to delay elements 106 and 108.

Inverting amplifier 118 is connected between delay elements 114 and 116. Inverting amplifier 118 has a unity gain, but its output has the opposite polarity of its input.

The signal at node B, the output of inverting amplifier 118 and the output of delay element 116 are provided as inputs to AND gate 120. Here, AND gate 120 is a collection of analog circuit elements and operates on analog signals, but performs a function similar to a conventional digital AND gate. When all three of the inputs to AND gate 120 are positive, AND gate 120 produces a positive output.

When rabbit ear pattern 404 (FIG. 4B) is applied at node B, second stage 104 produces pulse 406 (FIG. 4C) as an output. Other signals applied at node B, such as pattern 410 (FIG. 4B) do not cause a pulse at node C. Thus, second stage 104 produces a pulse at node C when there is a pulse in the input signal at node A.

As can be seen in FIGS. 4A and 4C, the pulse 406 at node C is delayed four unit delays behind the pulse 402 at node A. Delay elements 124, 126, 128, and 130 delay the input signal at node A by four unit delays. Thus, a pulse at node A will arrive at the inputs of AND gate 122 at the same time as a pulse at node C. AND gate 122 represents an analog gate. The signal out of delay element 130 will pass through AND gate 122 when the signal at node C is positive. In this way, the pulses in the image from detector 50 (FIG. 2) are passed by point detect filter 54. The pulses have thus been filtered out of the image and can be further processed.

Having described one embodiment of the invention, various alterations could be made without departing from the inventive concept. For example, the output of point detect filter 54 could be taken at node C. The signal at node C contains a pulse for each pulse of the input image. However, the magnitude of the signal at node C is dictated by the workings of AND gate 120 and is not related to the strength of the pulse at the input. If no information on the amplitude of pulses in the image is required, AND gate 122 and delay elements 124, 126, 128, and 130 do not need to be included.

Moreover, the preferred embodiment has been described in conjunction with an EW system. This invention might be used in any system in which a small pulse must be detected in the presence of a background signal with large variations.

It is felt, therefore, that the invention should be limited only by the spirit and scope of the appended claims.

What is claimed is:

1. A filter for detecting pulses in a signal comprising:

a) a first filter stage having a predetermined response to a pulse, the first filter stage comprising:

i) a first delay element having an input and an output;

ii) a second delay element having an input and an output with the input of the second delay element connected to the output of the first delay element;

iii) an inverting amplifier with a gain of two having an input and an output, the input of the inverting amplifier being connected to the output of the first delay element;

iv) a summer having three inputs, one input being connected to the input of the first delay element, one input being connected to the output of the inverting amplifier and one input being connected to the output of the second delay element; and b) a second filter stage having its input coupled to the output of the first filter stage, said second filter stage producing a pulse at its output in response to the predetermined response.

2. The filter of claim 1 wherein the first predetermined response comprises a signal having a portion with a first polarity followed by a second portion with a second polarity followed by a third portion with the first polarity.

3. The filter of claim 2 wherein the portion with the second polarity has a magnitude twice that of the magnitude of the portion with the first polarity.

4. The filter of claim 1 additionally comprising:

a) means for delaying the input signal;

b) means, coupled to the delay means and to the second filter stage, for passing the delayed input when the output of the second filter stage is a pulse.

5. The filter of claim 1 in an electronic warfare system comprising:

a) an infrared detector having its output coupled to the input of the filter; and b) means, coupled to the output of the filter, for processing a signal.

6. The electronic warfare system of claim 5 wherein the means for processing a signal comprises means for identifying a track made by a missile in an image formed by the output of the infrared detector.

7. An electronic warfare system comprising:

a) an infrared detector producing a scanned image at its output;

b) a filter connected to the output of the infrared detector comprising:

(i) a first means for producing a first characteristic response to a pulse at its input;

(ii) a second means, coupled to the output of the first means, for producing a second characteristic response in response to the first characteristic response; and c) processing means, coupled to the output of the second producing means, for associating occurrences of the second characteristic response with the presence of a target.

8. The electronic warfare system of claim 7 wherein the first characteristic response consists essentially of a rabbit ear pattern.

9. The electronic warfare system of claim 8 wherein the second characteristic response consists essentially of a pulse.

10. The electronic warfare system of claim 7 wherein the processing means comprises means for determining when separate occurrences of the second characteristic response are generated by a line in the scanned image perpendicular to the direction of scanning.

* * * * *